US008356886B2

(12) United States Patent
Shimizu

(10) Patent No.: US 8,356,886 B2
(45) Date of Patent: Jan. 22, 2013

(54) LIQUID EJECTION HEAD AND INK-JET PRINTER

(75) Inventor: Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 538 days.

(21) Appl. No.: 12/624,524

(22) Filed: Nov. 24, 2009

(65) Prior Publication Data

US 2010/0134571 A1 Jun. 3, 2010

(30) Foreign Application Priority Data

Nov. 28, 2008 (JP) ..... 2008-303501

(51) Int. Cl.
*B41J 2/05* (2006.01)

(52) U.S. Cl. ..... 347/65

(58) Field of Classification Search ..... 347/56, 347/54, 44, 45, 47, 63, 64, 65, 68–72
See application file for complete search history.

(56) References Cited

U.S. PATENT DOCUMENTS

| | | | | |
|---|---|---|---|---|
| 7,241,000 | B2 | 7/2007 | Hirota et al. | |
| 2004/0056918 | A1 | 3/2004 | Wang et al. | |
| 2006/0103700 | A1 | 5/2006 | Taira | |
| 2007/0139484 | A1 | 6/2007 | Taira et al. | |
| 2007/0229602 | A1 | 10/2007 | Taira et al. | |
| 2009/0219344 | A1* | 9/2009 | Suzuki | 347/54 |
| 2009/0289006 | A1 | 11/2009 | Nakajima et al. | |

FOREIGN PATENT DOCUMENTS

| | | | |
|---|---|---|---|
| JP | 2004-114335 | A | 4/2004 |
| JP | 2005-169839 | A | 6/2005 |
| JP | 2006-168339 | A | 6/2006 |
| JP | 2007-160251 | A | 6/2007 |
| JP | 2007-160821 | A | 6/2007 |
| JP | 2007-268868 | A | 10/2007 |
| JP | 2007-301799 | A | 11/2007 |

OTHER PUBLICATIONS

Japan Patent Office; Notice of Reasons for Rejection in Japanese Patent Application No. 2008-303501 mailed on Aug. 17, 2010.

* cited by examiner

*Primary Examiner* — Kristal Feggins
(74) *Attorney, Agent, or Firm* — Baker Botts L.L.P.

(57) ABSTRACT

A liquid ejection head may include a first flow channel member and a second flow channel member, wherein the first flow channel member and the second flow channel member are disposed to form a liquid supply flow channel configured to supply liquid to an ejection port, a supply and discharge flow channel communicated with a supply port and a discharge port, and a communicating flow channel configured to communicate the supply and discharge flow channel to the liquid supply flow channel. The liquid ejection head may also include a seal member which constitutes a part of the supply and discharge flow channel and connects the first flow channel member to the second flow channel member in a watertight manner. The communicating flow channel may be communicated with the supply and discharge flow channel via a filter disposed in the interior of the second flow channel member.

11 Claims, 11 Drawing Sheets

LIQUID EJECTION HEAD AND INK-JET PRINTER

CROSS REFERENCE TO RELATED APPLICATION

This application claims priority to Japanese Patent Application No. 2008-303501, filed Nov. 28, 2008, the entire subject mater and disclosure of which is incorporated herein by reference.

BACKGROUND OF THE DISCLOSURE

1. Field of the Disclosure

The features herein relate to a liquid ejection head formed with a liquid flow channel configured to supply liquid to ejection ports, and an ink-jet printer including the liquid ejection head.

2. Description of the Related Art

A known liquid ejection head includes a pressuring tube that is connected to an ink liquid chamber in the liquid ejection head and configured to pressurize the ink liquid chamber, and a removing tube that is connected to the ink liquid chamber and configured to remove air bubbles in the ink liquid chamber.

SUMMARY OF THE DISCLOSURE

In the liquid ejection head as described above, a liquid flow channel may be formed to across a plurality of, e.g., two, flow channel members. In such a case, adhesiveness between the flow channel members may be secured, for example, by arranging an O-ring formed of an elastic material at a position where the liquid flow channels of the plurality of flow channel members are joined. However, in this case, since the flow channel member formed of the elastic material is low in gas-barrier characteristics, air may enter and accumulate in the liquid flow channel.

A need has arisen for a liquid ejection head in which air can hardly be accumulated in a liquid flow channel when the liquid flow channel is formed across the plurality of flow channel members, and an ink-jet printer comprising the liquid ejection head.

According to one embodiment herein, a liquid ejection head may include a first flow channel member and a second flow channel member, wherein the first flow channel member and the second flow channel member are disposed so as to form a liquid supply flow channel configured to supply liquid to an ejection port configured to eject liquid, a supply and discharge flow channel communicated with a supply port from the outside and a discharge port to the outside, and a communicating flow channel configured to communicate the supply and discharge flow channel to the liquid supply flow channel. The liquid ejection head may also include a seal member formed of an elastic material, wherein the seal member constitutes a part of the supply and discharge flow channel and connects the first flow channel member to the second flow channel member in a water-tight manner. The communicating flow channel may be communicated with the supply and discharge flow channel via a filter disposed in the interior of the second flow channel member.

DETAILED DESCRIPTION OF EMBODIMENTS

Various embodiments, and their features and advantages, may be understood by referring to FIGS. 1 to 11, like numerals being used for corresponding parts in the various drawings.

Figure 1:
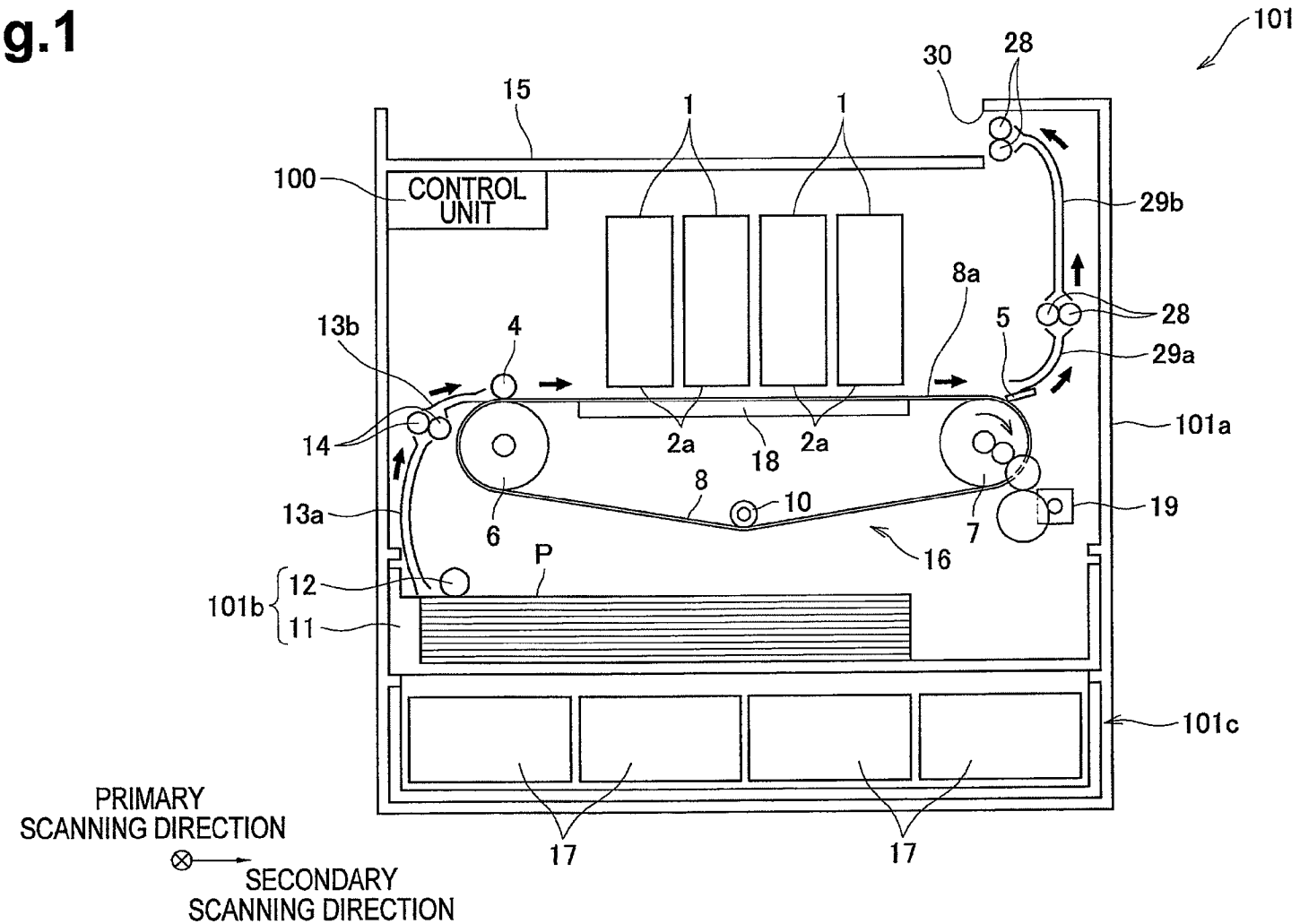
FIG. 1 is a vertical cross-sectional view showing an internal configuration of an ink-jet printer comprising an ink-jet head according to an embodiment.

Referring to FIG. 1, an ink-jet printer 101 comprises a housing 101*a* of a parallelepiped shape. A plurality of, e.g., four, ink-jet heads 1 that eject ink in magenta, cyan, yellow and black respectively and a transporting device 16 are arranged in the housing 101*a*. A control unit 100 configured to control an operation of the ink-jet heads 1 and the transporting device 16 is mounted on an inner surface of a top panel of the housing 101*a*. A paper feed unit 101*b* which is demountably mounted on the housing 101*a* is arranged under the transporting device 16. An ink tank unit 101*c* which is demountably mounted with respect to the housing 101*a* is arranged below the paper feed unit 101*b*.

A paper transporting path is formed in the interior of the ink-jet printer 101 along a thick arrow indicated in FIG. 1, such that a paper P is transported from the paper feed unit 101*b* to a paper discharging portion 15. The paper feed unit 101*b* comprises a paper feed tray 11 and a paper feed roller 12. The paper feed tray 11 is formed into a box shape opening upward, and a plurality of pieces of the paper P are stored in a stacked state. The paper feed roller 12 feeds the uppermost paper P on the paper feed tray 11. The fed paper P is guided by guides 13*a* and 13*b* and fed to the transporting device 16 while being pinched by a roller pair 14.

The transporting device 16 comprises a plurality of, e.g., two, belt rollers 6 and 7, a transporting belt 8, a tension roller 10, and a platen 18. The transporting belt 8 is an endless belt wound around the belt rollers 6 and 7 so as to run therebetween. The tension roller 10 is urged downward while being in contact with an inner peripheral surface of a lower loop of the transporting belt 8, and applies a tension to the transporting belt 8. The platen 18 is arranged in an area surrounded by the transporting belt 8, and supports the transporting belt 8 such that the transporting belt 8 does not sag downward at a position opposing the ink-jet head 1. The belt roller 7 is a driving roller which rotates clockwise in FIG. 1 by a drive force applied to a shaft thereof from a transporting motor 19. The belt roller 6 is a driven roller which is rotated clockwise in FIG. 1 by the transporting belt 8 being traveled by a rotation of the belt roller 7. The drive force of the transporting motor 19 is transmitted to the belt roller 7 via a plurality of gears.

An outer peripheral surface 8*a* of the transporting belt 8 has an adhesive characteristic by being siliconized. A nip roller 4 is arranged at a position opposing the belt roller 6. The nip roller 4 presses the paper P fed from the paper feed unit 101*b* against the outer peripheral surface 8*a* of the transporting belt 8. The paper P pressed against the outer peripheral surface 8*a* is transported in the paper transporting direction (rightward in FIG. 1 and secondary scanning direction) while being held on the outer peripheral surface 8*a* by its adhesion.

A separating plate 5 is provided at a position opposing the belt roller 7. The separating plate 5 separates the paper P from the outer peripheral surface 8*a*. The separated paper P is guided by guides 29*a* and 29*b*, and is transported while being pinched between two feed roller pairs 28. The paper P is discharged from a discharge port 30 formed on an upper portion of the housing 101*a* to a paper discharging depression (paper discharging portion) 15 provided on an upper surface of the housing 101*a*.

The plurality of, e.g., four, ink-jet heads 1 eject ink in colors different from each other (magenta, yellow, cyan, and black). The plurality of ink-jet heads 1 each have a substantially parallelepiped shape elongated in the primary scanning direction. The plurality of ink-jet heads 1 are arranged and fixed along a transporting direction A of the paper P. In other words, the printer 101 may be a line-type printer.

A bottom surface of the ink-jet head 1 configures an ejection surface 2*a* comprising a plurality of ejection ports 108 (see FIG. 9) for ejecting ink formed therethrough. When the transported paper P passes right below the plurality of ink-jet heads 1, the inks in respective colors are discharged in sequence from the ejection ports 108 to an upper surface of the paper P. Accordingly, a desired color image is formed on the upper surface, that is, a printing surface of the paper P.

The respective ink-jet heads 1 are connected to ink tanks 17 in the ink tank unit 101*c*. Inks in colors different from each other are stored in the plurality of, e.g., four, ink tanks 17. The inks are supplied from the respective ink tanks 17 to the ink-jet heads 1 via tubes.

Figure 2:
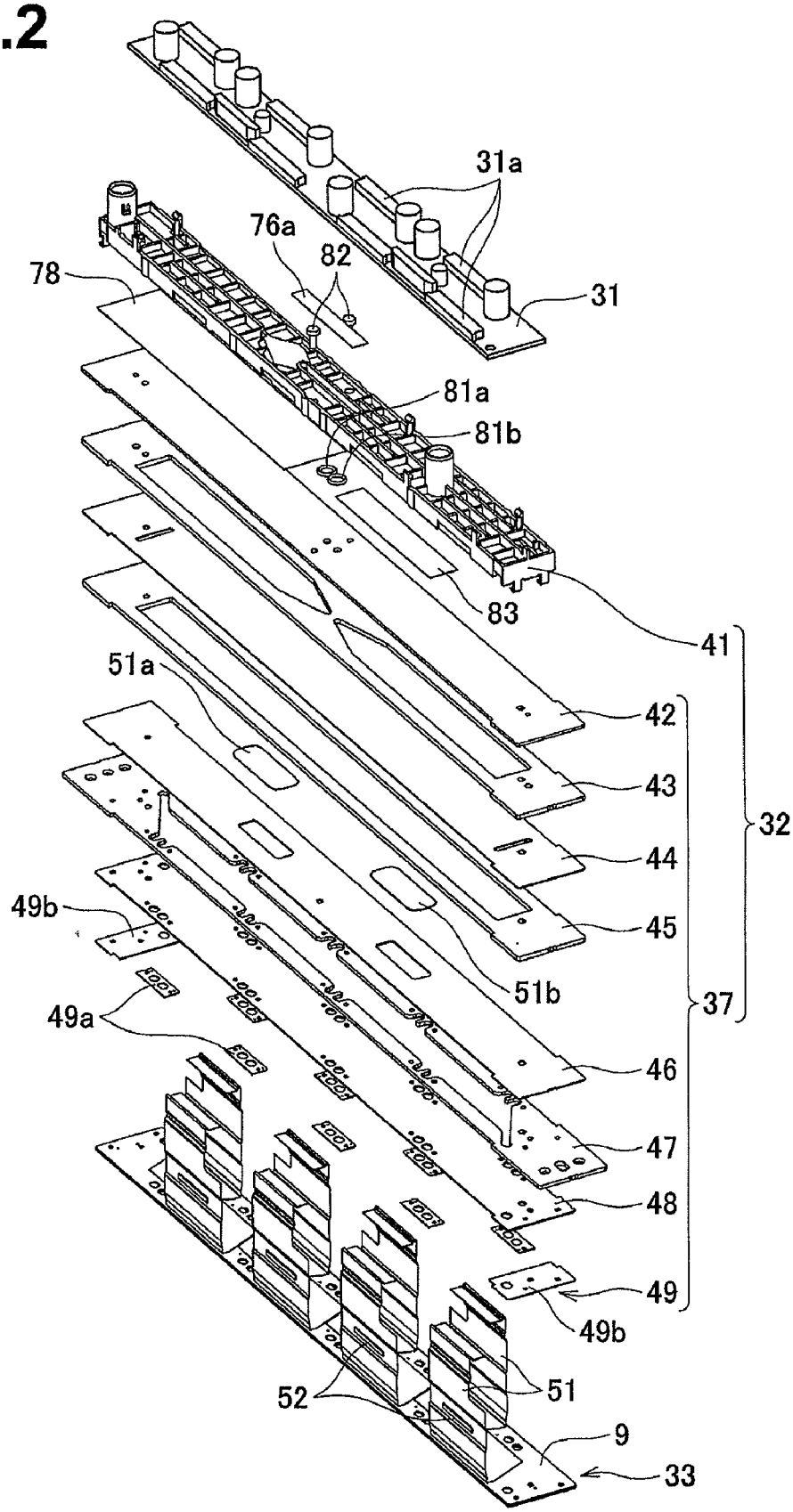
FIG. 2 is an exploded perspective view of the ink-jet head.
Figure 3:
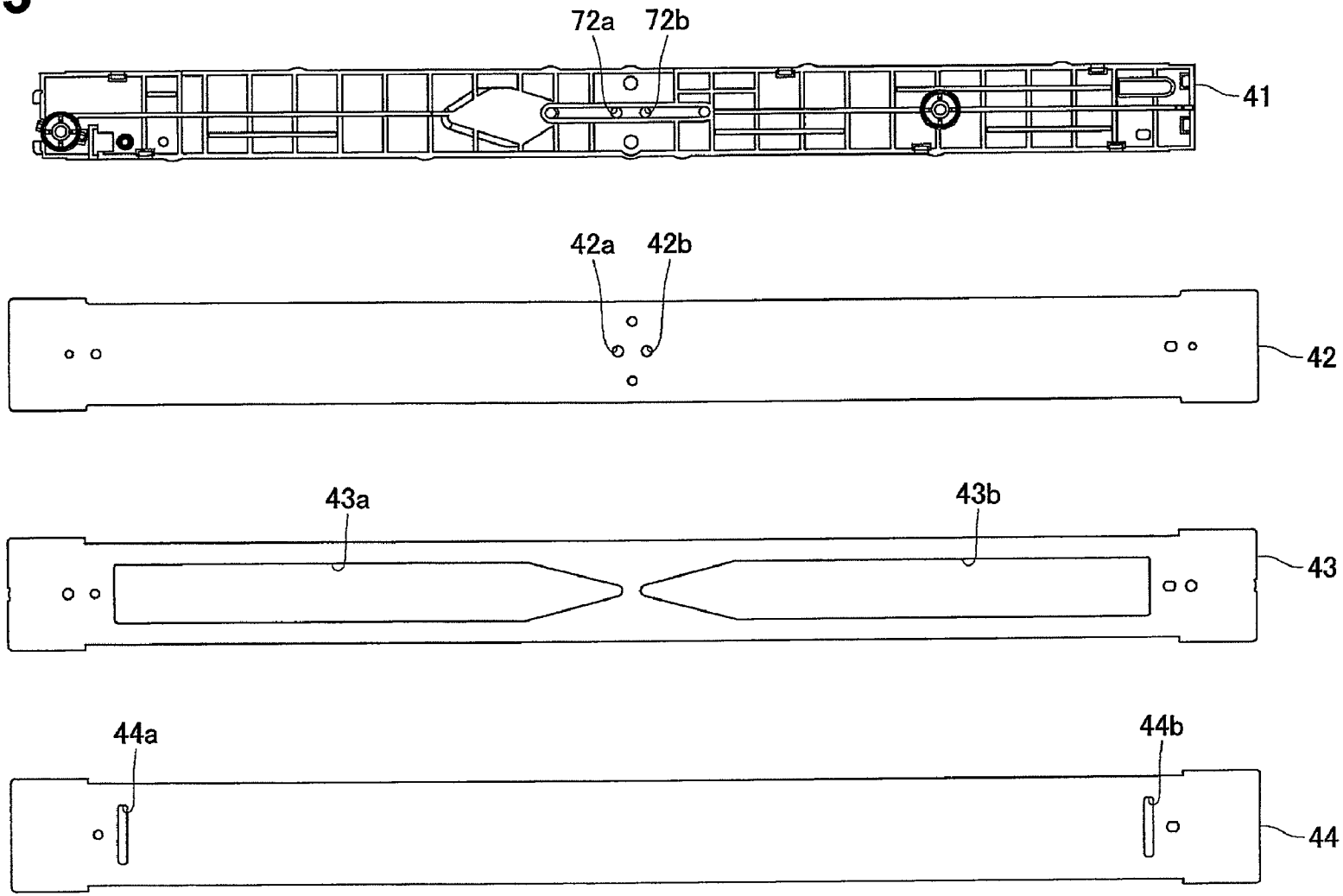
FIG. 3 is a plan view of a plurality of members which configure the ink-jet head.
Figure 4:
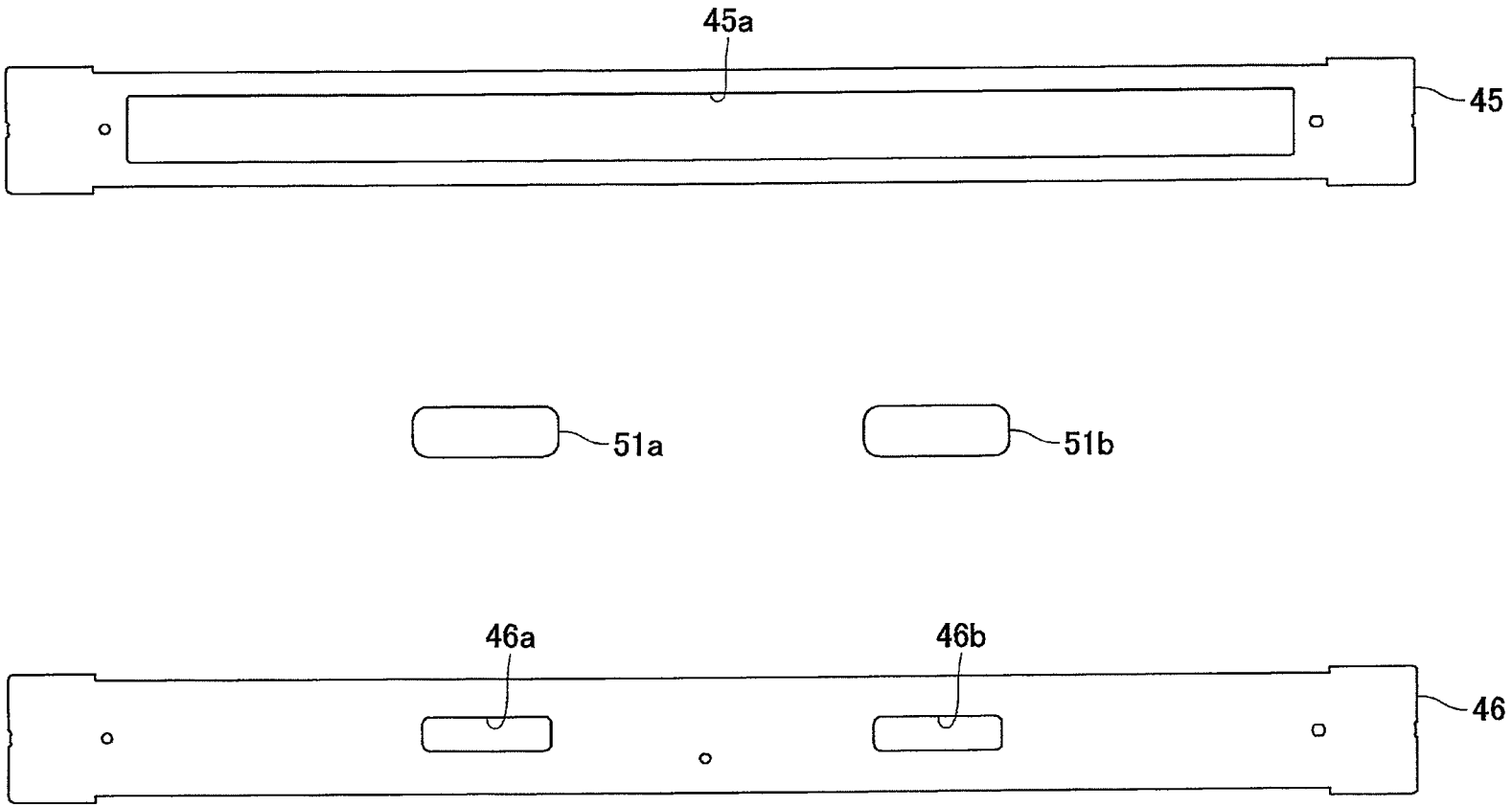
FIG. 4 is a plan view of a plurality of members which configure the ink-jet head.
Figure 5:
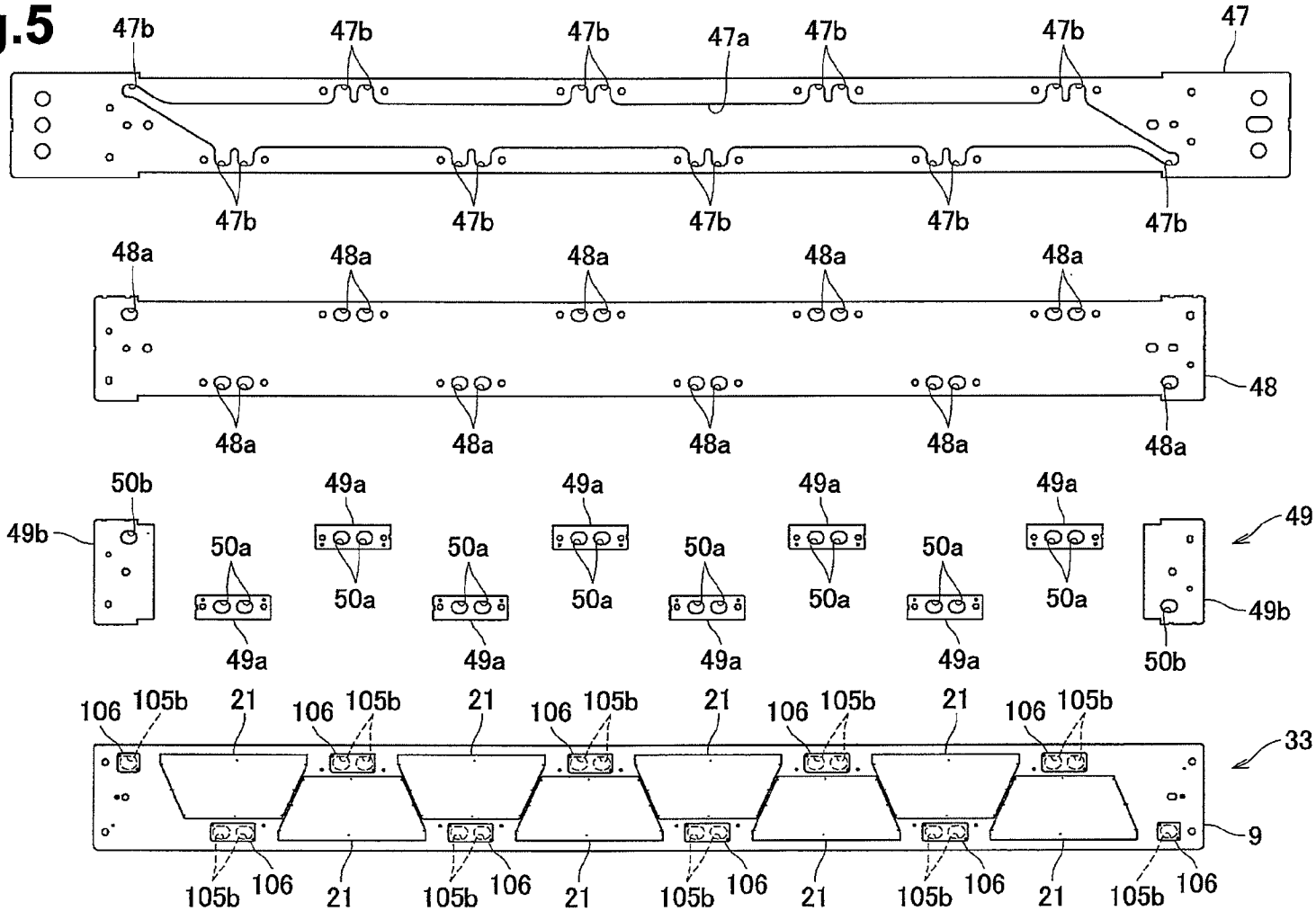
FIG. 5 is a plan view of a plurality of members which configure the ink-jet head.

Referring to FIG. 2, the ink-jet head 1 has a laminated structure, in which a substrate 31, a reservoir unit 32, and a head body 33 comprising a flow channel unit 9 are laminated. Referring to FIG. 2 to FIG. 5, the reservoir unit 32 is configured in such a manner that an ink supply member 41 is fixed on an upper surface of a laminated member 37 formed by laminating seven plates 42 to 48 and a small plate group 49 by screws 82. The small plate group 49 comprises a plurality of, e.g., eight, small plates 49*a* and a plurality of, e.g., two, small plates 49*b*.

Figure 6A:
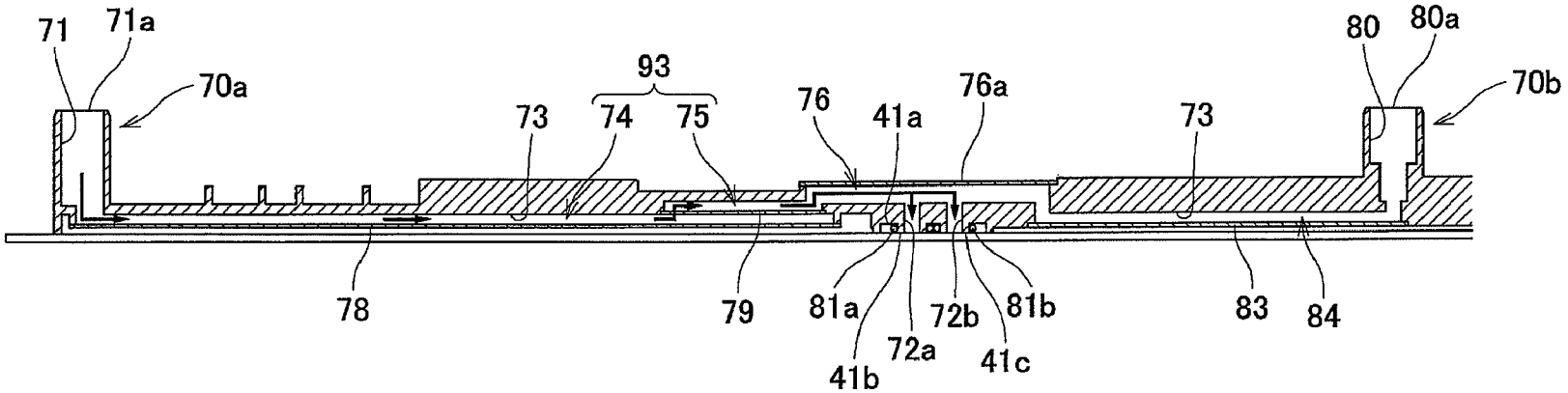
FIG. 6A is a cross-sectional plan view of an ink supply member comprised in the ink-jet head.

Referring to FIG. 6A, the ink supply member 41 is formed integrally of resin. A plurality of, e.g., two, cylindrical projections 70*a* and 70*b* project upward from an upper surface of the ink supply member 41. The cylindrical projection 70*a* is arranged at a left end of the ink supply member 41 in FIG. 6A, and the cylindrical projection 70*b* is arranged in the vicinity of a right end of the ink supply member 41 in FIG. 6A. A supply port 71*a* is opened for receiving a supply of ink from the ink tank 17 at an upper end of the cylindrical projection 70*a*. A flexible tube is attached to the cylindrical projection 70*a*. Then, the ink from the ink tank 17 as an ink supply source is introduced into the ink supply member 41 from the supply port 71*a* via the tube. In contrast, the cylindrical projection 70*b* is opened at an upper end thereof with a discharge port 80*a* for discharging air entrained in the ink.

The ink supply member 41 is formed with an ink flow channel 73 extending from the supply port 71*a* to the discharge port 80*a* in the interior thereof. The cylindrical projections 70*a* and 70*b* each are formed with an inlet hole 71 and an outlet hole 80, which are part of the ink flow channel 73, in the interior thereof. The inlet hole 71 extends vertically downward from the supply port 71*a*, and the outlet hole 80 extends vertically downward from the discharge port 80*a*. The ink flow channel 73 extends from a lower end of the inlet hole to a lower end of the outlet hole 80 substantially horizontally. A plurality of, e.g., two outlet holes 72*a* and 72*b* are branched from the ink flow channel 73 at a portion in the vicinity of a lateral center in FIG. 6A. The ink flow channel 73 comprises an intermediate hole 93 between the inlet hole 71 and the outlet hole 80.

A filter 79 for filtering the ink is attached to the ink supply member 41. The filter 79 divides the intermediate hole 93 into a first space 74 communicating with the inlet hole 71 and a second space 75 communicating with the outlet hole 80. In the second space 75, a non-opposed area 76 which does not oppose the filter 79 extends horizontally at a level slightly higher than an area in the second space 75 opposing the filter 79. The plurality of, e.g., two, outlet holes 72*a* and 72*b* extend vertically downward from the non-opposed area 76 and open from a lower surface of the ink supply member 41.

The first space 74 has an elongated rectangular shape, and opens from the lower surface of the ink supply member 41. The opening is sealed by a damper film 78 having the substantially same shape as the first space 74 in plan view. The damper film 78 extends horizontally along the first space 74. Accordingly, the damper film 78 defines the ink flow channel 73 in cooperation with the ink supply member 41.

The second space 75 opposes a portion from a position slightly rightward from a center of the damper film 78 to a right end, and has a tapered shape toward the normal direction and the reverse direction in terms of the ink flow respectively. The filter 79 has a substantially similar shape as the shape of the second space 75 in plan view, and has a shape slightly larger than the second space 75 in plan view. The filter 79 is fixed to an inner surface of the ink supply member 41 so as to cover an area in the second space 75 opposing the damper film 78 from below. In other words, the filter 79 is attached to the ink supply member 41 so as to oppose both the second space 75 and the damper film 78.

A third space 84 is formed in an area from the non-opposed area 76 to the outlet hole 80 in the ink flow channel 73. The third space 84 is bent from a right end of the non-opposed area 76 downward once and then extends horizontally therefrom toward the outlet hole 80. A portion of the third space 84 extending horizontally opens from the lower surface of the ink supply member 41. A damper film 83 is adhered to the lower surface of the ink supply member 41 so as to seal the opening of the third space 84.

Figure 6B:
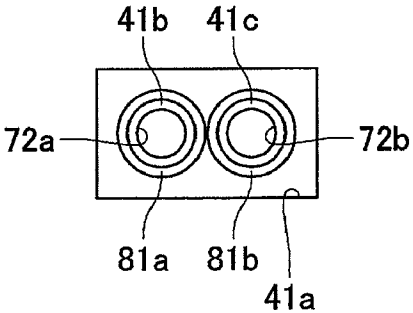
FIG. 6B is an enlarged bottom plan view in the vicinity of a depressed portion of the ink supply member.

The lower surface of the ink supply member 41 is formed with a depressed portion 41*a* so as to surround the outlet holes 72*a* and 72*b* in plan view. As shown in FIG. 6B, the depressed portion 41*a* is formed so as to leave cylindrical portions 41*b* and 41*c* formed with the outlet holes 72*a* and 72*b* in the interior thereof.

Then, O-rings 81*a* and 81*b* formed of an elastic material such as rubber are fitted around the cylindrical portions 41*b* and 41*c*. Inner diameters of the O-rings 81*a* and 81*b* are formed to be slightly smaller than outer diameters of the cylindrical portions 41*b* and 41*c* so as to tighten the cylindrical portions 41*b* and 41*c* by the elasticity when being attached to the cylindrical portions 41*b* and 41*c*. The thicknesses of the O-rings 81*a* and 81*b* are slightly larger than the depth of the depressed portion 41*a*, such that the O-rings 81*a* and 81*b* are caught and collapsed between an inner surface of the depressed portion 41*a* and the upper surface of the laminated member 37 when the ink supply member 41 is fixed by the screw 82 on the upper surface of the laminated member 37 (see FIG. 2).

In this configuration, when the ink supply member 41 is fixed to the laminated member 37, the collapsed O-rings try to restore the original shapes by the elasticity thereof, thereby coming into tight contact with both the ink supply member 41 and the laminated member 37 to clog the clearance therebetween. Therefore, the ink supply member 41 and the laminated member 37 are connected in a water-tight manner so as to prevent the ink from leaking from between the ink supply member 41 and the laminated member 37 when the ink flows in the outlet holes 72*a* and 72*b*.

The ink from the supply port 71*a* flows substantially horizontally from left to right in the first space 74, and flows upward from the area opposing the filter 79 along the filter 79 as shown in FIG. 6A. Then the ink flows into the second space 75 via the filter 79. At this time, foreign substances existing in the ink in the first space 74 is caught by the filter 79, such that the ink free from the foreign substance flows from the first space 74 to the second space 75. Then, the ink passes through the non-opposed area 76 in the second space 75, flows in the outlet holes 72*a* and 72*b* downward, and flows out from the outlet holes 72*a* and 72*b* to the plate 42.

The damper films 78 and 83 are formed of resin film having flexibility. A gap is interposed between the damper films 78 and 83 and an upper surface of the plate 42 so as to allow the damper films 78 and 83 to be displaced according to the vibrations of the ink. In this configuration, the damper films 78 and 83 are displaced substantially in the vertical direction according to the vibrations of the ink and absorb and attenuate the vibrations of the ink.

The upper surface of the ink supply member 41 is formed with an opening for communicating the non-opposed area 76 and the outside. Then, the opening is sealed with a film 76*a*. The film 76*a* has flexibility and absorbs and attenuates the vibrations of the ink by being displaced according to the vibrations of the ink.

The laminated member 37 comprising the plates 42 to 48 and the small plate group 49 constitutes part of a second flow channel member. Respective members in the laminated member 37 are metallic flat panels, and the respective members are formed with through holes which constitute an ink flow channel through which the ink is supplied from the ink supply member 41.

More specifically, the plate 42 is formed with a plurality of, e.g., two, through holes 42*a* and 42*b*, which oppose the outlet holes 72*a* and 72*b* near the center of the plate 42, so as to penetrate through the plate 42 in the thickness direction. The plurality of, e.g., two, through holes 42*a* and 42*b* are connected to the outlet holes 72*a* and 72*b* respectively by the O-rings 81*a* and 81*b*. The upper surface of the plate 42 opposes the lower surface of the ink supply member 41.

The plate 43 is formed with a plurality of, e.g., two, through holes 43*a* and 43*b* extending from near the center of the plate 43 to near both ends, respectively. The through holes 43*a* and 43*b* each have a tapered area narrowed toward the center of the plate 43. The respective through holes 43*a* and 43*b* oppose the corresponding through holes 42*a* and 42*b* near distal ends of the tapered areas. The plate 44 is formed with slit-like through holes 44*a* and 44*b* respectively near both ends thereof. The through holes 44*a* and 44*b* extend in the widthwise direction of the plate 44 and oppose near outer ends of the corresponding through holes 43*a* and 43*b*.

The plate 45 is formed with a rectangular elongated through hole 45*a* extending from near one end of the plate 45 to near the other end thereof. The through hole 45*a* opposes the through holes 44*a* and 44*b* near both ends thereof. The plate 46 is formed with through holes 46*a* and 46*b* at symmetrical positions with respect to the center in terms of the longitudinal direction. The through holes 46*a* and 46*b* each have an elongated rectangular shape in plan view in terms of the longitudinal direction of the plate 46. Filters 51*a* and 51*b* for allowing the ink in the through hole 45*a* to flow into the through holes 46*a* and 46*b* after having removed the foreign substances are adhered to an upper surface of the plate 46 so as to cover the through holes 46*a* and 46*b*.

With the configuration as described above, when the plate 42 to plate 46 are laminated in addition to the ink supply member 41, a branch flow channel which is branched at the outlet hole 72*a* which is located in the ink supply member 41 on the side of the supply port 71*a* of the ink flow channel 73, and joins the ink flow channel 73 at the outlet hole 72*b* positioned on the side of the discharge port 80*a* with respect to the outlet hole 72*a* is formed. Most part of the branch flow channel is formed in the reservoir unit 32 except for the ink supply member 41, and part of a flow channel wall is formed by the plurality of, e.g., two, filters 51*a* and 51*b* at a midsection of the branch flow channel. Both end portions of the branch flow channel exist in the ink supply member 41, and one is the outlet hole 72*a* and the other is the outlet hole 72*b*.

The plate 47 is formed with an elongated through hole 47*a* extending from near one end of the plate 47 to near the other end thereof. The through hole 47*a* opposes the through holes 46*a* and 46*b*. The through hole 47*a* has a plurality of, e.g., eighteen, protrusions 47*b* projecting horizontally from both sides in the width direction toward end edges of the plate 47. The protrusions 47*b* may be arranged nine each in two rows along the longitudinal direction of the plate 47. The nine protrusions 47*b* which constitute each row are arranged such that two each are close to each other in pair except for ones arranged on the outermost sides. The arrangement of the plurality of, e.g., eighteen, protrusions 47*b* has point symmetry with respect to the center of the plate 47.

The plate 48 is formed with substantially circular shaped through holes 48*a* at positions opposing the protrusions 47*b*. The plurality of, e.g., eighteen, through holes 48*a* are provided corresponding to the plurality of, e.g., eighteen protrusions 47*b*.

The plurality of, e.g., eight, small plates 49*a* from the small plate group 49 each are formed with a plurality of, e.g., two, through holes 50*a* opposing the plurality of, e.g., two, through holes 48*a* in proximity to each other. Then, the plurality of, e.g., two, small plates 49*b* arranged so as to interpose the eight small plates 49*a* in terms of the longitudinal direction of the ink-jet head 1 each are formed with one through hole 50*b* opposing the outermost through hole 48*a* in each row.

The plates 42 to 47 and the through holes 50*a* and 50*b* formed on the small plate group 49 communicate with each other, and form an ink flow channel for supplying the ink from the ink supply member 41 to the head body 33. In other words, when the plates 42 to 49 are laminated in addition to the ink supply member 41, the reservoir unit 32 is further formed with communicating flow channels, and one ends of the communicating flow channels communicate with the branch flow channel via the two filters 51*a* and 51*b*. The other ends of the communicating flow channels are the through holes 48*a* of the plate 48 and the through holes 50*a* and 50*b* of the small plate group 49 corresponding thereto, which function as inlet flow channels which communicate with a manifold flow channel 105.

The head body 33 comprises the flow channel unit 9, and a plurality of, e.g., ten, head-body filers 106, and eight actuator units 21 fixed to an upper surface of the flow channel unit 9. The head body 33 configures part of the second flow channel member, and configures the second flow channel member entirely together with the laminated member 37. The head-body filers 106 are provided one each for a plurality of, e.g., ten, small plates 49*a* and 49*b*, and cover one or two ink supply ports 105*b*.

The head body 33 has the ejection surface 2*a* on a lower surface thereof, and formed with a liquid supply flow channel (i.e., the manifold flow channel 105 and a secondary manifold flow channel 105*a* described later) communicating the plurality of the ejection ports 108 in the interior thereof. The reservoir unit 32 and the head body 33 are laminated and one end of the liquid supply flow channel communicates with the other end of the communicating flow channel via the head-body filters 106. At this time, the reservoir unit 32 and the head body 33 are laminated from the inlet flow channel in the direction of inflow into the manifold flow channel 105.

Figure 9:
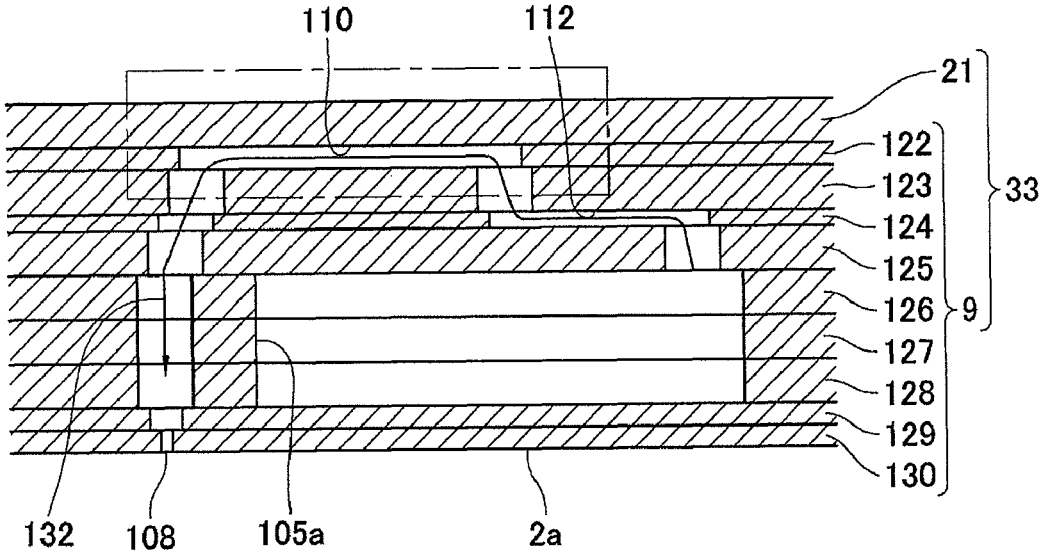
FIG. 9 is a cross-sectional view taken along the line IX-IX shown in FIG. 8.

The actuator units 21 each comprise a plurality of piezoelectric actuators which apply an ejection energy to the ink in a pressure chamber 110 (see FIG. 9). COFs 51 as flat flexible substrates are joined to upper surfaces of the respective actuator units 21. Driver IC 52 for generating drive signals to be supplied to the actuator units 21 are mounted on the COFs 51.

The substrate 31 comprises a plurality of electronic components arranged thereon. The COFs 51 are connected to the plurality of electronic components on the substrate 31 via connectors 31*a* attached to the substrate 31. The plurality of electronic components on the substrate 31 are connected to the control unit 100 via a wiring, not shown.

Figure 7:
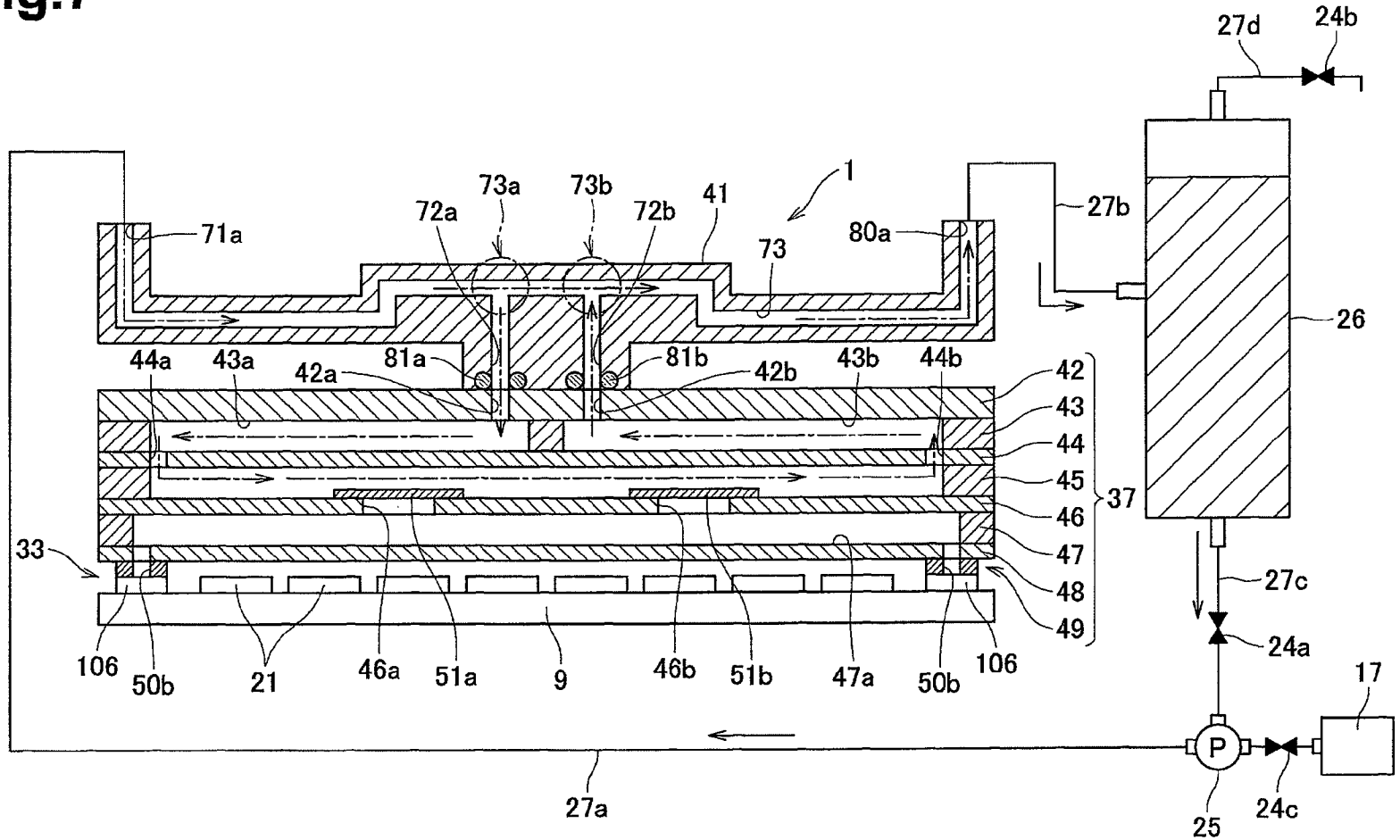
FIG. 7 is a diagrammatic sketch including a cross-sectional view showing the ink-jet head along the longitudinal direction and an ink circulating mechanism connected to the ink-jet head.

The ink-jet printer 101 comprises a circulating mechanism for circulating the ink inside and outside the ink-jet head 1 for removing the air entered into the ink flow channels in the ink-jet head 1. As shown in FIG. 7, the ink circulating mechanism comprises a pump 25 configured to suck the ink from the ink tank 17 and supply the ink to the ink-jet head 1 and a sub tank 26 for separating air from the ink. In addition, the ink circulating mechanism comprises an ink tube 27*a* configured to connect the pump 25 and the supply port 71*a* of the ink supply member 41, an ink tube 27*b* adapted to connect the discharge port 80*a* and an inlet port of the sub tank 26, and an ink tube 27*c* configured to connect an outlet port of the sub tank 26 and the pump 25. The ink tube 27*c* is provided with an opening and closing valve 24*a* at a midsection thereof for starting or stopping the circulation. An air discharge tube 27*d* comprising an opening and closing valve 24*b* interposed therein is connected to an upper portion of the sub tank 26 so as to allow the air in the sub tank 26 to be released to the atmosphere. An opening and closing valve 24*c* is also interposed between the ink tank 17 and the pump 25. In the ink-jet head 1 shown in FIG. 7, aspect ratios of the respective members are significantly changed for allowing the flow channel to be clearly viewed.

In order to discharge the air in the ink-jet head 1, the pump 25 is driven by the control unit 100 with the opening and closing valve 24*a* closed, the opening and closing valve 24*b* opened, and the opening and closing valve 24*c* opened. Accordingly, fresh ink is supplied to the ink-jet head 1, and the air in the ink-jet head 1 flows into the sub tank 26 with the ink. In the sub tank 26, the air is separated from the ink and is moved upward, and then is released into the atmosphere via the air discharge tube 27*d*.

Meanwhile, in the ink-jet head 1, the ink flows in the ink flow channel 73 from the supply port 71*a* toward the discharge port 80*a*. Furthermore, the ink is branched at a first position 73*a* where the outlet hole 72*a* is connected at the midsection of the ink flow channel 73, and also flows into the branch flow channel. The ink in the branch flow channel is joined with the ink flowing in the ink flow channel 73 at a second position 73*b* where the outlet hole 72*b* is connected.

The partial flow channel comprises a straight portion extending from the first position to the second position. A flow channel resistance of the branch flow channel between the first position 73*a* and the second position 73*b* is adjusted to be 10 times to 20 times the flow channel resistance of the ink flow channel 73. Accordingly, the ink flow that can discharge air bubbles is formed in the branch flow channel, and ink meniscuses formed at the ejection ports 108 are not broken.

A flow from the outlet hole 72*a* toward the outlet hole 72*b* is generated in the branch flow channel, and the ink flows along the surfaces of the filters 51*a* and 51*b* on the side of the branch flow channel. Here, when the air enters the flow channel via the O-rings 81*a* and 81*b*, the air moves to the outlet hole 72*b* with the flow of the ink in the branch flow channel. Although the air bubbles are adhered to the surfaces of the filters 51*a* and 51*b*, these air babbles are also moved in the same manner. The ink joined at the second position 73*b* is separated from the air in the sub tank 26.

When this state is continued for a predetermined time, the interior of a supply and discharge flow channel comprising the partial flow channel and the branch flow channel is filled with fresh ink. At this time, the pump 25 is preferably driven to an extent that the flow of the ink into the communicating flow channel via the filters 51*a* and 51*b* is not generated by utilizing high flow channel resistances of the filters 51*a* and 51*b*. Accordingly, the air bubbles in the supply and discharge flow channel are reliably discharged.

At the time of the initial introduction of the ink, the pump 25 is driven by the control unit 100 a bit strongly after the supply and discharge flow channel is filled with ink, such that the ink is caused to flow toward the communicating flow channel side via the filters 51*a* and 51*b*. In addition, the ink flows into the liquid supply flow channel via the head-body filer 106, and finally reaches the ejection ports 108. Accordingly, the interior of the ink-jet head 1 is filled with fresh ink.

In order to circulate the ink, the pump 25 is driven by the control unit 100 with the opening and closing valve 24*a* opened and the opening and closing valve 24*b* closed, and the opening and closing valve 24*c* closed. Accordingly, the ink is circulated from the pump 25, the ink-jet head 1, the sub tank 26 and again to the pump 25.

In this embodiment, a flow channel extending from the supply port 71*a* to the discharge port 80*a* via the ink flow channel 73, the outlet hole 72*a*, the through holes 42*a*, 43*a*, 44*a*, 45*a*, 44*b*, 43*b*, and 42*b*, the outlet hole 72*b*, and the ink flow channel 73 in sequence corresponds to the supply and discharge flow channel. Also, the communicating flow channel corresponds to a flow channel being communicated with the supply and discharge flow channel via the filters 51*a* and 51*b* and allowing the ink to flow to the head body 33 via the through holes 46*a*, 46*b*, 47*a*, 50*a*, and 50*b*.

Figure 8:
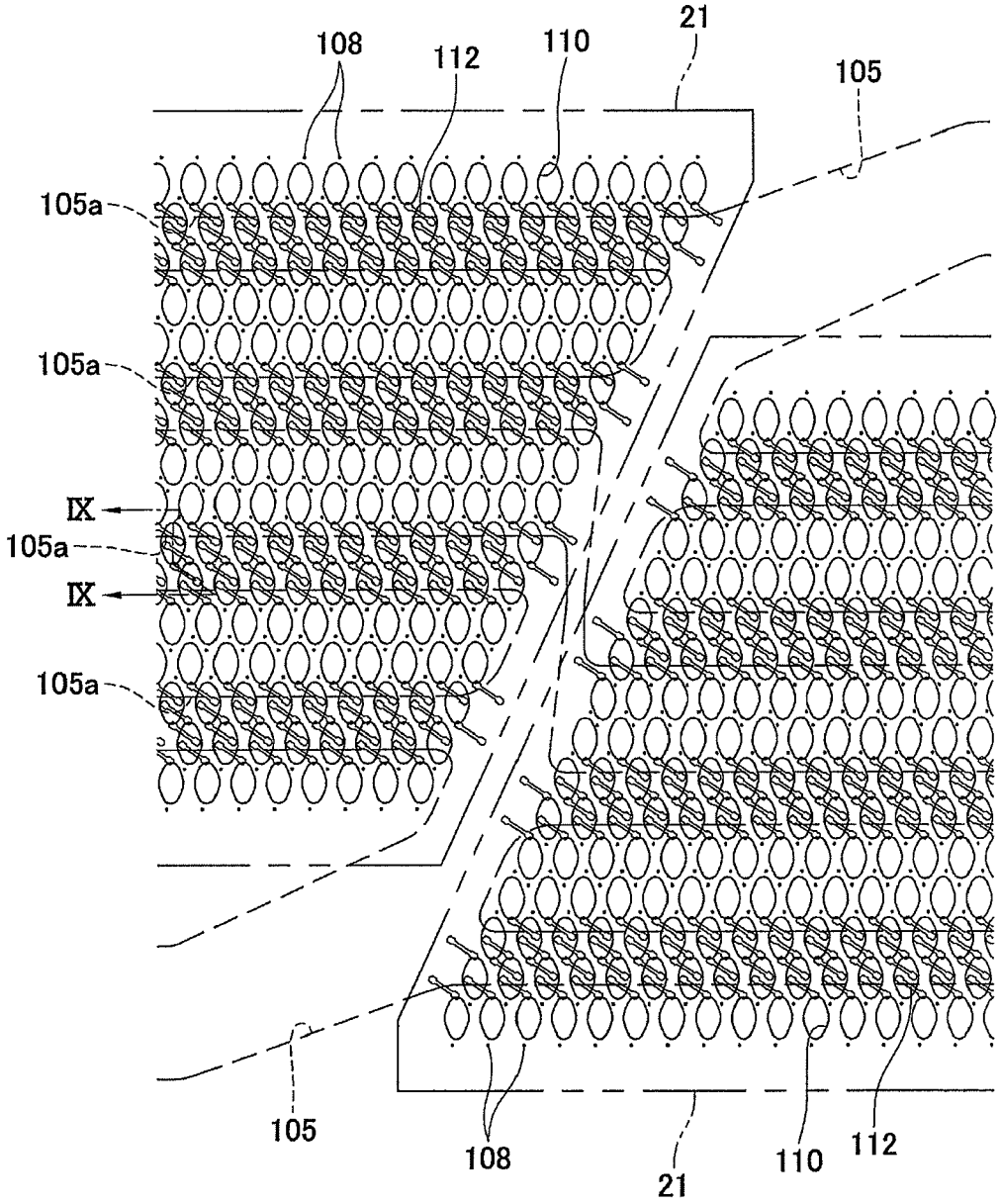
FIG. 8 is a partially enlarged plan view of a flow channel unit comprised in the ink-jet head.

Referring to FIG. 8, the head body 33 comprises the ejection ports 108 configured to eject ink and the liquid supply flow channel configured to supply the ink to the ejection ports 108 formed as described below. On the upper surface of the flow channel unit 9, a plurality of the pressure chambers 110 having a rhombic shape in plan view are arranged regularly in a matrix pattern. The actuator units 21 each comprise a plurality of individual electrodes 135 (see FIG. 10A) provided so as to oppose the plurality of the pressure chambers 110 formed on the flow channel unit 9 and have a function to selectively provide the ejection energy to the ink in the pressure chambers 110.

The plurality of, e.g., eighteen, ink supply ports 105*b* in total are opened on the upper surface of the flow channel unit 9 corresponding to a plurality of eighteen inlet flow channels of the reservoir unit 32. The ink supply port 105*b* is covered with the head-body filer 106 finer than the filters 51*a* and 51*b*. A plurality of the manifold flow channels 105 starting from the ink supply port 105*b*, and a plurality of the secondary manifold flow channels 105*a* as common liquid flow channels branched from the manifold flow channels 105 are formed in the interior of the flow channel unit 9. A lower surface of the flow channel unit 9 corresponds to the ejection surface 2*a* having the plurality of ejection ports 108 as openings of nozzles arranged regularly in a matrix pattern.

Referring to FIG. 9, the flow channel unit 9 comprises a plurality of, e.g., nine, metallic plates comprising a cavity plate 122, a base plate 123, an aperture plate 124, a supply plate 125, three manifold plates 126, 127 and 128, a cover plate 129, and a nozzle plate 130. These nine plates 122 to 130 each have a rectangular shape elongated in the primary scanning direction in plan view.

A plurality of individual ink flow channels 132 extending from exits of the secondary manifold flow channels 105*a* to the ejection ports 108 via the pressure chambers 110 are formed in the flow channel unit 9 by the plurality of, e.g., nine, plates 122 to 130 laminated in position. The ink supplied from the reservoir unit 32 to the flow channel unit 9 via the ink supply ports 105*b* enters the secondary manifold flow channels 105*a* from the manifold flow channels 105. The ink in the secondary manifold flow channels 105*a* flows into the individual ink flow channels 132, and reaches the ejection ports 108 of nozzles via the apertures 112 which function as restrictions and the pressure chambers 110. In this embodiment, the flow channel communicating with the inlet flow channel via the head-body filer 106 on one side and reaching the plurality of ejection ports 108 on the other side corresponds to the liquid supply flow channel.

Referring back to FIG. 5, a plurality of, e.g., eight, actuator units 21 each have a trapezoidal shape in plan view. The actuator units are arranged in a zigzag pattern in terms of the longitudinal direction of the flow channel unit 9 so as to avoid the ink supply ports 105*b*. Parallel opposed sides of the each actuator unit 21 extend along the longitudinal direction of the flow channel unit 9, and oblique sides of the adjacent actuator units 21 are overlapped with each other in terms of the longitudinal direction of the flow channel unit 9, that is, in terms of the primary scanning direction (see FIG. 8).

Figure 10A:
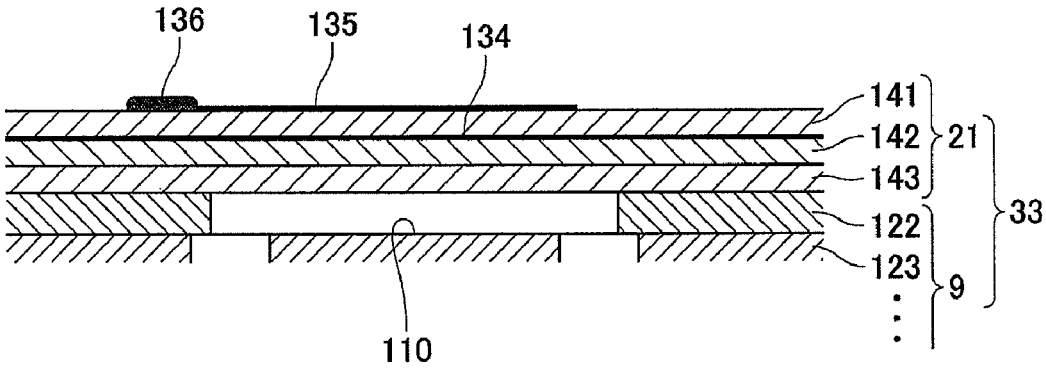
FIG. 10A is an enlarged cross-sectional view of an actuator unit.
Figure 10B:
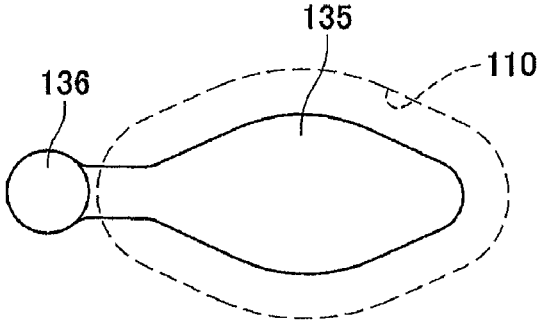
FIG. 10B is a plan view of an individual electrode of the actuator unit.

Referring to FIG. 10A, the actuator units 21 each comprise a plurality of, e.g., three, piezoelectric layers 141 to 143 configured of ceramic material based on lead zirconate titanate (PZT) having a ferroelectricity. The individual electrode 135 is positioned on the uppermost piezoelectric layer 141 in an area opposing the pressure chamber 110. A common electrode 134 is interposed between the uppermost piezoelectric layer 141 and the next piezoelectric layer 142 extending over the piezoelectric layer 141 and 142. The individual electrode 135 has a substantially rhombic shape in plan view which is similar to the pressure chamber 110 as shown in FIG. 10B. One of the arcuate corners of the individual electrode 135 extends to the outside of the pressure chamber 110, and a circular land 136 electrically connected to the individual electrode 135 is provided at a distal end thereof. A land for the common electrode is also positioned on an upper surface of the piezoelectric layer 141 in addition to the land 136 for the individual electrode. The land for the common electrode is connected to the common electrode via an electric conductor in a through hole.

A ground potential as a reference potential is applied to the common electrode 134 by the COF 51. In contrast, the individual electrode 135 is electrically connected to a terminal provided on the driver IC 52 via the each land 136 and the internal wiring of the COF 51. A drive signal for driving the actuator unit 21 is supplied from the driver IC independently to the each individual electrode 135. Therefore, a portion interposed between the individual electrode 135 and the pressure chamber 110 works as an independent actuator in the each actuator unit 21. In other words, a plurality of actuators as energy applying members are built in the actuator unit 21 by the same number as that of the pressure chambers 110.

A method of driving the actuator unit 21 for causing ink drops to be ejected from nozzles will be described. The piezoelectric layer 141 is polarized in the thickness direction thereof. When an electric field is impressed on the piezoelectric layer 141 in the direction of polarization with the individual electrode 135 being different in potential from the common electrode 134, an electric field impressed portion of the piezoelectric layer 141 functions as an active portion which is distorted by a piezoelectric effect. The active portion extends in the thickness direction and contracts in the plane direction when the directions of the electric field and polarization are the same. The amount of displacement at this time in association with the extension and contraction is larger in the plane direction than in the thickness direction. In the actuator unit 21, the piezoelectric layer 141 which is farthest from the pressure chambers 110 is a layer comprising the active portions and the two piezoelectric layers 142 and 143 on the lower side and closer to the pressure chambers 110 are non-active layers. Since the piezoelectric layer 143 is fixed to an upper surface of the cavity plate 122 which defines the pressure chambers 110 as shown in FIG. 10A, if there arises a difference in distortion in the plane direction between the electric field impressed portion of the piezoelectric layer 141, and the piezoelectric layers 142 and 143 disposed below, the piezoelectric layers 141 to 143 are entirely deformed so as to project toward the pressure chamber 110 in a Unimorph mode. Accordingly, a pressure is applied to the ink in the pressure chambers 110, such that pressure waves are generated in the pressure chambers 110. Then, by the generated pressure waves propagated from the pressure chambers 110 to the nozzles of the ejection ports 108, the ink drops are ejected from the ejection ports 108.

When the actuator units 21 are driven to form an image on the paper P as described above, the circulation of the ink may be and may not be performed by the pump 25. However, since the air bubbles generated in the flow channel are always separated by the sub tank 26 from the ink by the performance of the circulation, such events that the ejection becomes impossible and the ejection performances change due to clogging of the ejection ports 108 are avoided.

According to the embodiment described above, since the air entered into the ink flow channel of the ink-jet head 1 is discharged out from the ink-jet head 1 by an ink circulating flow channel formed inside and outside of the ink-jet head 1, the air can hardly be accumulated in the ink-jet head 1. At this time, the air entered from the supply port 71*a*, the damper film 78, and the like directly into the ink flow channel 73 is discharged from the discharge port 80*a* out to the ink-jet head 1 by an ink flow directed toward the discharge port 80*a* along the ink flow channel 73.

Also, the branch flow channel which is branched from the ink flow channel 73 and allows the ink to pass along upper surfaces of the filters 51*a* and 51*b* in the laminated member 37 so as to straddle thereover is formed. Therefore, the air bubbles adhered to the filter 51*a* or the filter 51*b* are flushed by the ink flow in the branch flow channel, and are discharged from the discharge port 80*a* to the outside of the ink-jet head 1. In this manner, in the embodiment, the through holes 44*a* and 44*b* and 45*a* which constitute the branch flow channel are formed so as to straddle over the filter 51*a* and the filter 51*b* from the viewpoint to make the air bubbles or the like adhered to the filter 51*a* and the filter 51*b* discharged easily. In addition, from the viewpoint of storing a large amount of ink in the laminated member 37, the through holes 44*a* and 44*b* and 45*a* are formed so as to extend fully in the widthwise direction of the plate 44 or the plate 45.

Since the elastic material such as rubber is low in gas barrier characteristic, air tends to enter the ink flow channel easily at a portion of the ink flow channel formed partly of the elastic material like the O-rings 81*a* and 81*b*. In this embodiment, since the blanch flow channel passes the O-rings 81*a* and 81*b*, the air bubbles entrained in the ink flow channel via the O-rings 81*a* and 81*b* are flushed by the ink flow, and is discharged from the discharge port 80*a*.

The outlet holes 72*a* and 72*b* and the through holes 42*a* and 42*b* as a part of the branch flow channel extend along a linear path. Then, the ink-jet heads 1 are arranged in the ink-jet printer 101 such that the outlet holes 72*a* and 72*b* and the through holes 42*a* and 42*b* are aligned in the vertical direction. Accordingly, the air can easily be released from the laminated member 37 side into the ink flow channel 73. The outlet holes 72*a* and 72*b* and the through holes 42*a* and 42*b* do not necessarily have to be aligned in the vertical direction, and must simply intersect the horizontal direction.

In this embodiment, the flow channel resistance of the entire branch flow channel which is branched from the ink flow channel 73 at the first position 73*a* and joins the ink flow channel 73 at the second position 73*b* is adjusted to be approximately 10 times to 20 times the flow channel resistance of a shortest path extending from the first position 73*a* to the second position 73*b* along the ink flow channel 73. In other words, from the first position 73*a* to the second position 73*b*, the ink can flow by approximately 10 to 20 times more easily through the path extending along the ink flow channel 73 than the path extending along the branch flow channel directed toward the laminated member 37. Therefore, the air entered directly into the ink flow channel 73 via the supply port 71*a* and the damper film 78 can hardly be flowed to the branch flow channel side and is directed to the discharge port 80*a* along the ink flow channel 73.

Also, in this embodiment, the filters 51*a* and 51*b* are arranged in the laminated member 37. Accordingly, positions in the ink flow channel where the O-rings 81*a* and 81*b* are arranged are closer to the discharge port 80*a* than the positions where the filter 51*a* and the filter 51*b* are arranged.

Figure 11A:
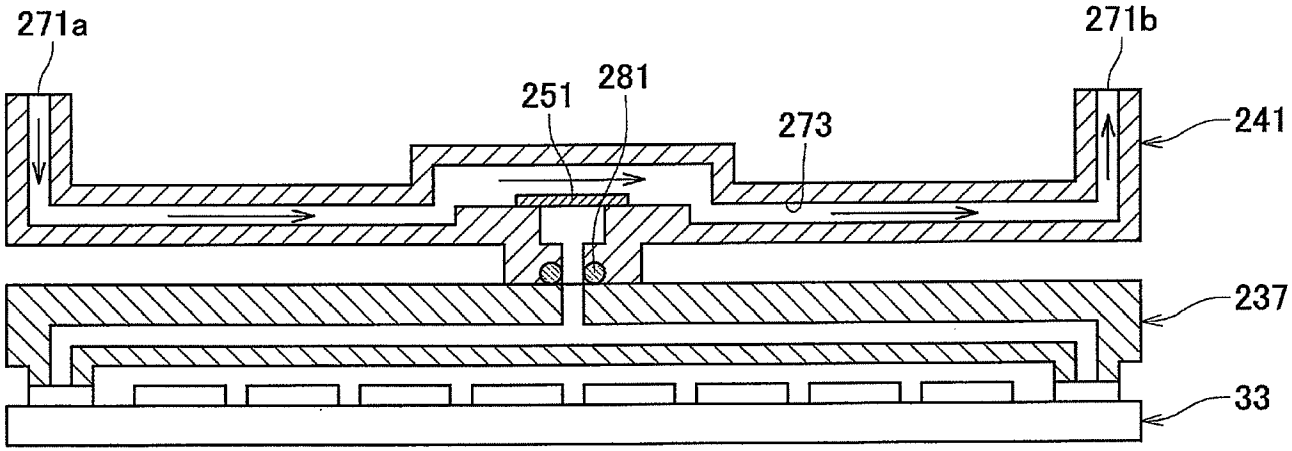
FIG. 11 is a schematic cross-sectional view taken along the longitudinal direction of the ink-jet head according to a modification.

In contrast, referring to FIG. 11A, when a filter 251 is not arranged in a laminated member 237, but arranged in an ink supply member 241, an O-ring 281 is arranged at a position farther from a discharge port 271*b* than the filter 251. In other words, the O-ring 281 is isolated from an ink flow channel 273 extending from a supply port 271*a* to the discharge port 271*b* by the filter 251 which has a very high flow channel resistance. In this case, the air entered from the O-ring 281 can easily be accumulated in the filter 251, and hence the air can hardly be discharged even when the ink flow is formed in the ink flow channel 273.

In contrast, according to the above-described embodiment, the O-rings 81*a* and 81*b* are arranged on the side of the discharge port 80*a* than the filters 51*a* and 51*b*. Therefore, an ink flow passing through the O-rings 81*a* and 81*b* and being directed toward the discharge port 80*a* can be formed without the intermediary of the filters. Therefore, the air entered from the O-rings 81*a* and 81*b* can easily be discharged from the discharge port 80*a* out from the ink-jet head 1.

Figure 11B:
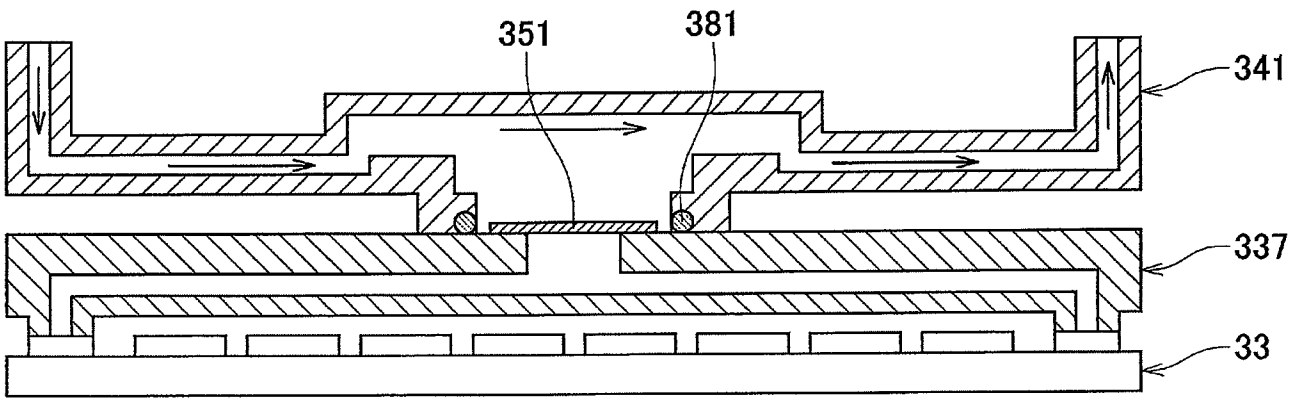

Referring to FIG. 11B, it is conceivable to arrange a filter 351 at a connecting portion between an ink supply member 341 and a laminated member 337. In this case, when the necessity to release the air from the laminated member 337 side is considered, the filter 351 is needed to have a certain amount of width as shown in FIG. 11B. Therefore, when the filter 351 is arranged at the connecting portion between the ink supply member 341 and the laminated member 337, an interface at the connecting portion is required to be upsized, although it depends on the size of the filter 351. In order to resist the ink pressure generated at the interface at the connecting portion, the ink supply member 341 and the laminated member 337 are required to be fixed with a larger force. Therefore, a pressure-resistant property of an O-ring 381 may be needed to be increased. However, when such increase in the force of fixation of the ink supply member 341 and the laminated member 337 is accepted, a configuration of the flow channel can be simplified, which contributes to reduction of the number of the components and downsizing of the ink-jet head.

In this embodiment, the ink supply member 41 is configured of resin, while the laminated member 37 is formed of metal. In this manner, when the two flow channel members are formed of different materials, adhesion using an adhesive agent may not be applied. For example, as a resin material having a high chemical-resistant characteristic (ink-resistant property), there is polypropylene or the like. However, when such a material is used, adhesion characteristic with the adhesive agent with respect to the metal may be low. Therefore, the screws 82 may be used to fix the ink supply member 41 to the laminated member 37, and the O-ring 81*a* formed of an elastic material having a low gas barrier characteristic may be used as in above-described embodiment.

Although the description of the embodiments has been described above, the invention is not limited thereto, and various modifications are possible.

For example, in the embodiment described above, the branch flow channel is branched from the ink flow channel 73 which connects the supply port 71*a* and the discharge port 80*a* toward the laminated member 37, whereby two ink circulating flow channels for discharging the air are formed. However, the number of the ink circulating channel may be only one. For example, a configuration in which the portion of the ink flow channel 73 between the first position 73*a* and the second position 73*b* is not formed and only the branch flow channel connects the first position 73*a* and the second position 73*b*. In this case, the air in the vicinity of the filters 51*a* and 51*b* and the O-rings 81*a* and 81*b* can be flushed away to the discharge port 80*a* by flowing the ink in the branch flow channel.

In the embodiment described above, the branch flow channel of the ink circulating flow channel is formed so as to straddle the connecting portion between the ink supply member 41 and the laminated member 37 twice. However, in the case where the discharge port 80*a* is provided on the side of the laminated member 37, the ink circulating flow channel may be formed so as to straddle the connecting portion between the ink supply member 41 and the laminated member 37 only once. Alternatively, it may be formed so as to straddle three times or more. In these cases, it is preferable to arrange an O-ring at each position where the ink circulating flow channel straddles the connecting portion between the ink supply member 41 and the laminated member 37.

In the embodiment described above, the ink supply member 41 and the laminated member 37 are configured of different materials. However, the two flow channel members are formed of the same material.

In the embodiment described above, the ink circulating flow channel is formed so as to allow the ink to flow along the surface of the filter 51*a* or the like. However, the filters 51*a* and 51*b* may be provided at the connecting portion of the ink flow channel between the plate 47 and the plate 48 instead of being adhered on the upper surface of the plate 46.

Although the above-described embodiment is according to the ink-jet head which ejects the ink from the nozzles, the present invention is not limited thereto. For example, the invention may be applied to liquid drop ejecting heads for ejecting conductive paste to form fine wiring patterns on a substrate, for ejecting organic light-emitting element on the substrate to form a high-definition display, or for ejecting optical resin on the substrate to form a minute electronic device such as an optical waveguide or the like.

What is claimed is:

1. A liquid ejection head comprising:

a first flow channel member and a second flow channel member, wherein the first flow channel member and the second flow channel member are disposed so as to form a liquid supply flow channel configured to supply liquid to an ejection port configured to eject liquid, a supply and discharge flow channel communicated with a supply port from the outside and a discharge port to the outside, and a communicating flow channel configured to communicate the supply and discharge flow channel to the liquid supply flow channel; and a seal member formed of an elastic material, wherein the seal member constitutes a part of the supply and discharge flow channel and connects the first flow channel member to the second flow channel member in a watertight manner, wherein the communicating flow channel is communicated with the supply and discharge flow channel via a filter disposed in the interior of the second flow channel member, and wherein the supply and discharge flow channel comprises a partial flow channel extending from the supply port to the discharge port, and a branch flow channel branching at a first position from the partial flow channel, passing through an area opposing the filter, and joining the partial flow channel at a second position closer to the discharge port than the first position.

2. The liquid ejection head according to claim 1, wherein the branch flow channel extends so as to straddle the filter from one side to the other side in the plane direction thereof at a portion opposing the filter.

3. The liquid ejection head according to claim 1, wherein the partial flow channel is formed in the interior of the first flow channel member, wherein the branch flow channel comprises a portion extending from the first flow channel member to the second flow channel member, and wherein the seal member constitutes a part of the portion extending from the first flow channel member to the second flow channel member in the branch flow channel.

4. The liquid ejection head according to claim 3, wherein the portion extending from the first flow channel member to the second flow channel member in the branch flow channel extends along a linear path.

5. The liquid ejection head according to claim 3, wherein the branch flow channel comprises a portion branching from the partial flow channel at the first position and extending to the second flow channel member, and a portion extending from the second flow channel member to the first flow channel member and joining the partial flow channel at the second position, and the seal members are disposed at the respective portions.

6. The liquid ejection head according to claim 1, wherein the partial flow channel comprises a straight portion extending from the first position to the second position.

7. The liquid ejection head according to claims 6, wherein a portion of the first flow channel member opposing the seal member is configured of a resin material.

8. The liquid ejection head according to claim 6, wherein a portion of the second flow channel member opposing the seal member is configured of metal.

9. The liquid ejection head according to claim 1, wherein a flow channel resistance from the first position to the second position in the partial flow channel is smaller than a flow channel resistance of the branch flow channel.

10. The liquid ejection head according to claims 1, wherein the communicating flow channel is communicated with the liquid supply flow channel via a head-body filter.

11. An ink jet printer comprising:

the liquid ejection head according to claim 1;

a transporting device configured to transport a recording medium fed from a recording medium feed unit; and a controller configured to control an operation of the liquid ejection head and the transporting device.

* * * * *